United States Patent [19]

Perkins

[11] Patent Number: 4,500,947

[45] Date of Patent: Feb. 19, 1985

[54] TRI SPHERICAL LENS ASSEMBLY

[75] Inventor: Frederick M. Perkins, Miami, Fla.

[73] Assignee: Perko, Inc., Miami, Fla.

[21] Appl. No.: 440,550

[22] Filed: Nov. 10, 1982

[51] Int. Cl.[3] ..... F21V 3/00

[52] U.S. Cl. ..... 362/311; 362/332; 362/335; 350/167

[58] Field of Search ..... 362/35, 61, 216, 145, 362/267, 309, 310, 311, 332, 335, 336, 362, 338, 362/317, 323, 339, 340; 340/29, 815.33; 350/442, 350/443, 167, 184; 9/8.3 R; D26/118

[56] References Cited

U.S. PATENT DOCUMENTS

| | | | |
|---|---|---|---|
| 565,269 | 8/1896 | Heimann | 362/332 |
| 748,753 | 1/1904 | Korff | 362/332 |
| 1,337,383 | 4/1920 | Alexovits | 340/29 |
| 1,520,405 | 12/1924 | Damm | 362/61 |
| 1,539,090 | 5/1925 | King | 362/335 X |
| 1,603,157 | 10/1926 | Sheaffer | 362/61 |
| 1,627,892 | 5/1927 | Frederick | 362/335 X |
| 1,651,984 | 12/1927 | Allen | 362/80 |
| 1,699,100 | 1/1929 | Dorey | 362/332 |
| 1,950,918 | 3/1934 | Forbes | 240/41.4 |
| 2,474,327 | 6/1949 | Rolph | 362/240 |
| 2,568,494 | 9/1951 | Geissbuhler | 240/41.4 |
| 2,673,288 | 3/1954 | Stevens | 240/41.36 |
| 2,767,306 | 10/1956 | Gaither | 240/7.1 A |
| 3,445,842 | 5/1969 | Charlton | 340/815.33 |
| 3,447,860 | 6/1969 | Lucas | 340/815.33 X |
| 3,818,210 | 6/1974 | Pitkjaan | 240/41.36 |
| 4,261,031 | 4/1981 | Fratty | 362/336 |
| 4,367,519 | 1/1983 | Houghton et al. | 362/335 X |

FOREIGN PATENT DOCUMENTS

| | | | |
|---|---|---|---|
| 705316 | 12/1978 | U.S.S.R. | 340/29 |

*Primary Examiner*—Peter A. Nelson

*Attorney, Agent, or Firm*—Gilbert L. Wells

[57] ABSTRACT

A marine navigation light having a first curved segment, a second curved segment, a vertical junction therebetween, and a single filament vertical light source is improved by reshaping the surfaces of the curved segments adjacent the junction so that light rays bend in the direction of the junction.

18 Claims, 9 Drawing Figures

FIG. 5
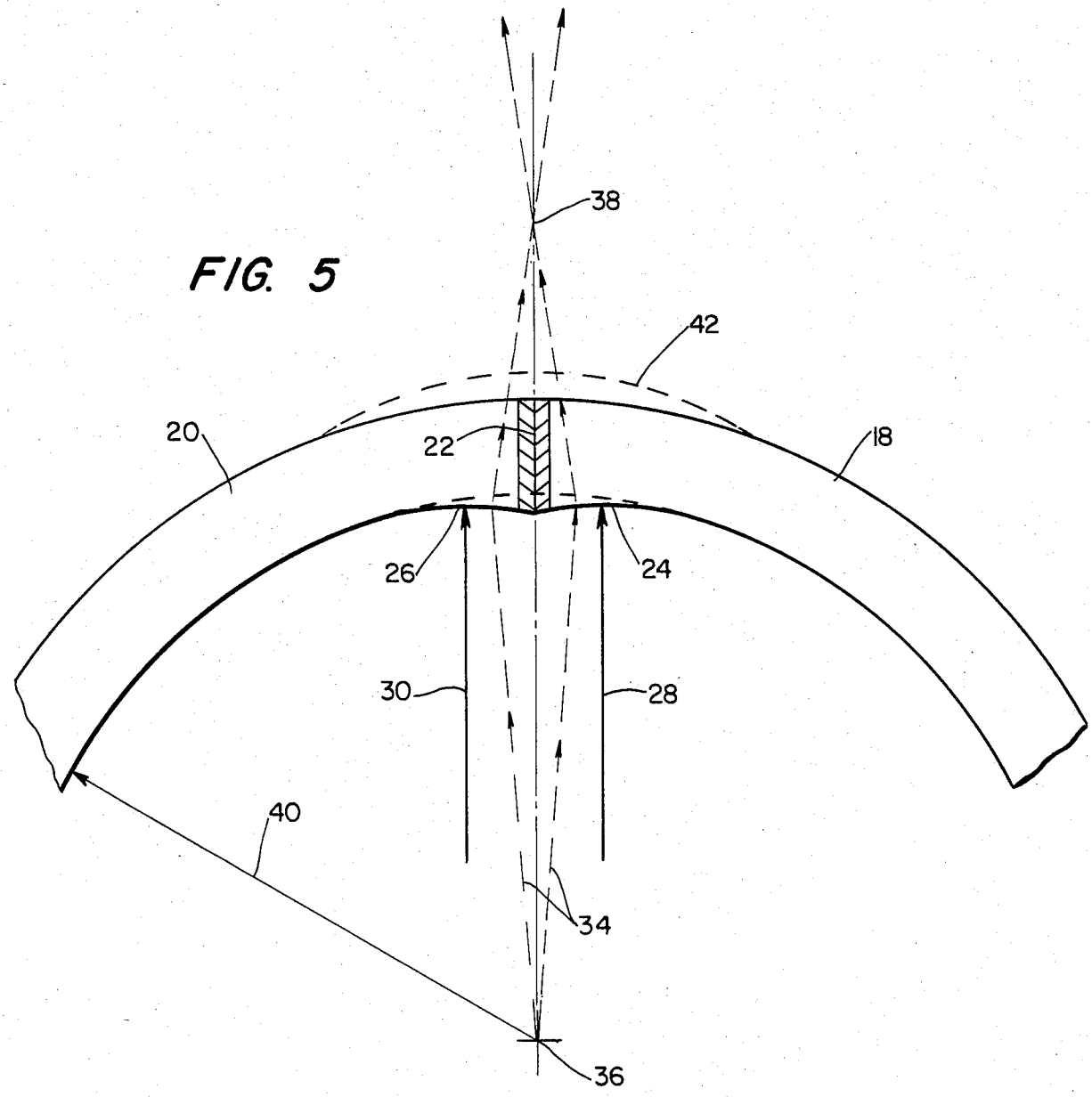
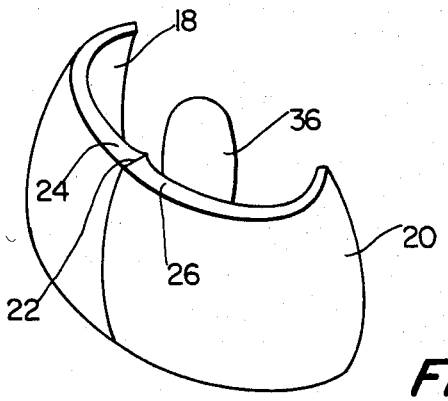
FIG. 9

TRI SPHERICAL LENS ASSEMBLY

BACKGROUND OF THE INVENTION

The field of the invention is illumination and the invention is particularly concerned with a tri-spherical lens assembly for marine use.

Earlier designs of marine navigation lights were in two forms: One consisted of a fixture with a single continuous lens, the other of a "combined" fixture with a single light source and two or three separate, usually colored, lenses either joined directly together or separated by a relatively thin opaque vertical divider.

The fixture with the continuous lens, by virtue of its uninterrupted arc of visibility, could be designed to emit light over any predetermined horizontal arc simply by adjusting the angle subtended by the lens segment. The combined fixture, however, contains regions at the lens segment junctions that obscure transmission of light at those points. These designs also employed lens dividers, which comprise thin vertical screens projecting radially outward from the junction, that prevented the light emitted from one lens segment from crossing over into the region of visibility of the other lens segment. The crossing was caused by the lamp filament design, which was generally oriented horizontal and perpendicular to the vertical plane passing through the lens junction and the center of the filament.

According to the current state of the art a problem arises with the use of a single vertical filament. This is particularly true with a C-8 filament. This filament orientation is preferred in order to improve the cut-off (reduction of light emission at the ends of the horizontal prescribed arc of visibility) of the fixture. Using this technique to improve cut-off creates the undesirable obscuration at the junctions of the lens segments. The horizontally broad light source no longer exists to negate the obscuring effect of the vertical junctions. It is necessary, then, to control the transmission of light through the respective lens segments in the vicinity of the junctions in order to replace the light obscured by the junction.

SUMMARY OF THE INVENTION

Having in mind the limitations of the prior art it is an object of the present invention to avoid the undesirable obscuration at the junctions of lens segments.

This object is achieved by a reshaped optical surface on the affected lens segment in the vicinity of the junction between two adjacent lens segments.

The usual optical system that employs this invention is comprised of a single light source with a vertical filament, multiple lens segments and either a divider or opaque junction region where segments are joined together. The prior art lens segments are usually transmissive plastic of not necessarily uniform thickness throughout, but with both the internal and external surfaces concentric on any given horizontal plane.

According to the present invention the optical surfaces adjacent to the junction are reshaped to progressively refract the rays as they approach the junction area. This is accomplished by changing the optical surface adjacent to the junction so that the normal to the line tangent to the curve and the incident ray at that point form an angle. The effect is that the ray is bent toward the obstruction at the internal air/lens interface. After passing through the lens medium, the ray is again refracted since the ray is no longer normal to the external surface. The result is a ray bent significantly toward the obstruction, due to the additive effects of refraction at both interfaces (internal and external). The modified surface is curved in such a way that at the farthest distance from the obstruction (where the modified surface begins), the normal to the modified surface is coincident with the normal to the unmodified surface. The normal to the modified surface then diverges from the unmodified normal progressively, as the obstruction is approached. This creates a gradual and increasing refraction of rays as the obstruction is approached, thus reducing the effect of a sharp decrease in light emission from the area of the lens segment from which the light has been borrowed. The degree to which the modified surface is reshaped, depends upon the size of the obstruction, the thickness of the lens segment, index of refraction, and the diameter of the lens assembly; and varies from fixture to fixture.

An alternative embodiment of the invention consists of the modification of the external lens surface in the same region. In this case, the normal of the reshaped surface progressively diverges from the unmodified normal in the opposite direction from the divergence obtained by the internal modification. Refraction only occurs at the external lens/air interface, bending the rays toward the obstruction.

BRIEF DESCRIPTION OF THE DRAWINGS

The present invention and its departure from the prior art are explained by reference to the appended drawings, wherein:

FIG. 5 is a schematic plan view of the lens system of the present invention having light rays eminating from a single vertical filament with a first embodiment of the reshaped optical system adjacent the lens segment junction shown in solid lines and a second embodiment shown in dotted lines;

FIG. 9 is a perspective view of the first embodiment of the lens system of the present invention.

DESCRIPTION OF THE PREFERRED EMBODIMENTS

Figure 1:
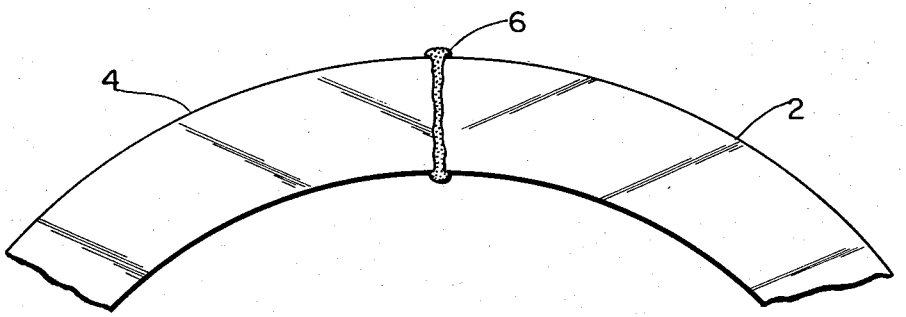
FIG. 1 PRIOR ART
FIG. 1 is a plan view of a prior art lens system showing a junction between left and right lens segments.

The state of the prior art is illustrated in FIGS. 1 through 4 wherein right lens segments 2 and left lens segments 4 are separated by junctions formed with a bonding agent 6 or a vertical divider 8.

Figure 4:
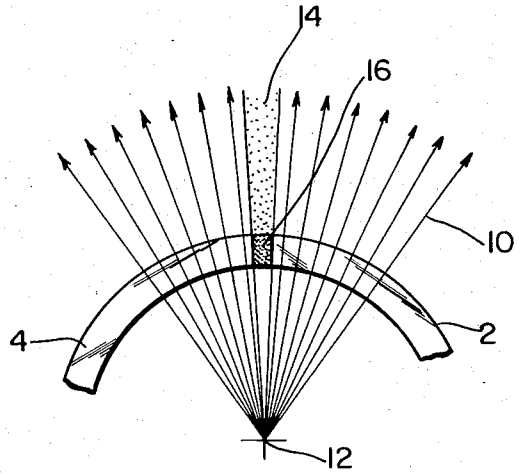
FIG. 4 PRIOR ART
FIG. 4 is a schematic plan view of a prior art lens system showing light rays eminating from a single vertical filament and the region obscured by the lens segment junction.
Figure 3:
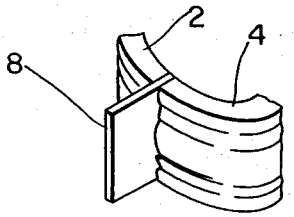
FIG. 3 PRIOR ART
FIG. 3 is a perspective view of the prior art lens system of FIG. 2 showing the vertical divider between the left and right lens segments.
Figure 2:
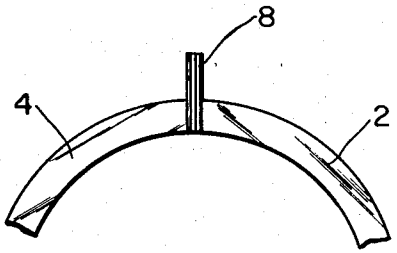
FIG. 2 PRIOR ART
FIG. 2 is a plan view of another prior art lens system showing a vertical divider between the left and right lens segments.

FIG. 4 shows the light pattern of rays 10 eminating from a single filament light source 12 and the region 14 obscured by the lens segment junction 16.

FIG. 5 shows the present invention with left lens segment 20 and right lens segment 18 separated by junction 22 which causes obscuration. Reshaped optical surfaces 24 and 26 having repositioned optical radii 28 and 30 respectively cause typical light rays 32 and 34 eminating from single filament light source 36 to refract at surfaces 24 and 26 and converge at point 38. The radius of lens segments 18 and 20 is designated 40. The second embodiment for reshaping the lens system is shown by the dotted lines indicated at 42.

Figure 6:
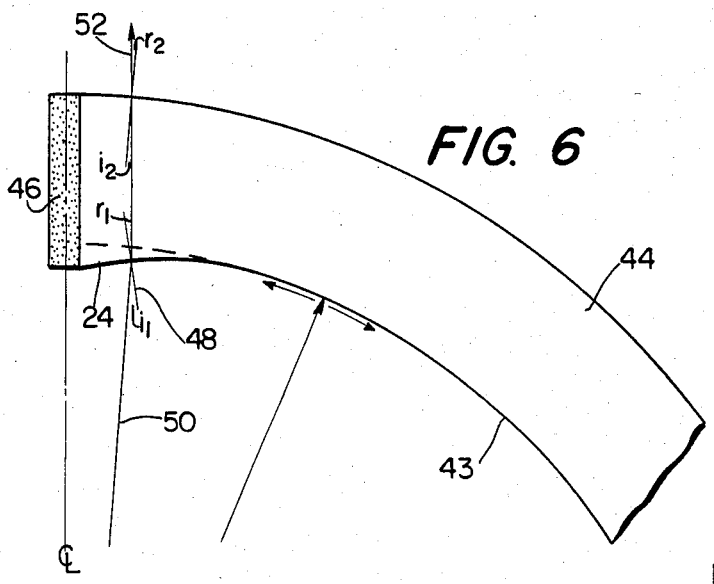
FIG. 6 is a detailed schematic plan view of the right lens of the present invention abutting a vertical divider or junction showing the first embodiment.

The principles involved in the present invention are explained with reference to FIGS. 6 and 7. With the light source 36 positioned at the center of the circles formed by the concentric internal unmodified surface 43 and the external unmodified surface 44 of the lens segments, a line tangent to the surfaces is always perpendicular to the incident ray emitted by the source, thus the ray is not refracted horizontally by the lens segment, since the incident ray is within a plane normal to the inside and outside surfaces. Considering horizontal refraction only (as the lens assembly may be designed to collimate or diverge the beam in the vertical plane), the law of refraction (Snell's Law) can be applied thus: $n_1 \sin i = n_2 \sin r$ where:

$n_1$ is the index of refraction of the first medium, i is the angle the incident ray forms with the normal to the surface, $n_2$ is the index of refraction of the second medium, and r is the angle the refracted ray forms with the normal to the surface.

In the above equation, the value of i equals 0° for the incident ray; sin i equals 0 and regardless of the values of the indices of refraction, sin r equals 0 and consequently r equals 0°. With no horizontal refraction of the rays, any vertical obstruction in the lens assembly causes obscuration of a corresponding segment within the desired arc of visibility of the fixture. This is the case with the vertical obstruction 46 at the junction of two lens segments.

In order to avoid this obscuration condition, the optical surfaces 24 and 42 adjacent to the junction are reshaped to progressively refract the rays as they approach the junction area. This is accomplished by changing an optical surface adjacent to the junction so that the normal 48 to the line tangent to the curve and the incident ray 50 at that point form an angle (i). The effect is that the ray is bent toward the obstruction at the internal air/lens interface. After passing through the lens medium, the ray is again refracted since the ray is no longer normal to the external surface. The result is a ray 52 bent significantly toward the obstruction, due to the additive effects of refraction at both interfaces (internal and external). The modified surfaces 24 and 42 are curved in such a way that at the farthest distance from the obstruction (where the modified surface begins), the normal 48 to the modified surface is coincident with the normal to the unmodified surface. The normal to the modified surface then diverges from the unmodified normal progressively, as the obstruction is approached. This creates a gradual and increasing refraction of rays as the obstruction is approached, thus reducing the effect of a sharp decrease in light emission from the area of the lens segment from which the light has been borrowed. The degree to which the modified surface is reshaped, depends upon the size of the obstruction, the thickness of the lens segment, index of refraction, and the diameter of the lens assembly; and varies from fixture to fixture.

Figure 7:
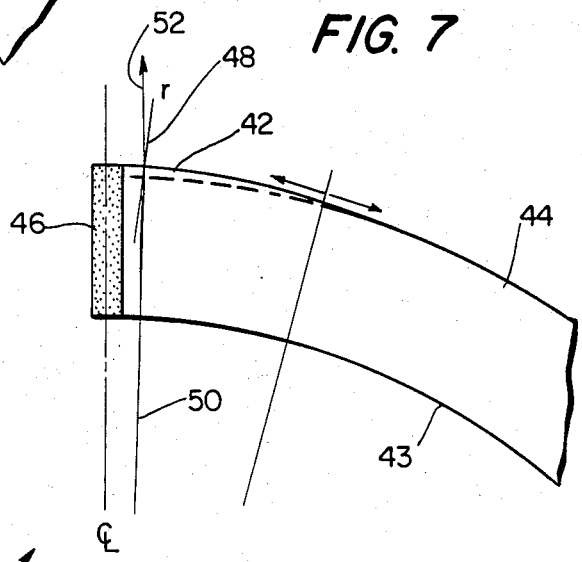
FIG. 7 is a detailed schematic plan view as in FIG. 6 but showing the second embodiment.

In the second embodiment of the invention the modification is to the external lens surface in the same region as shown in FIG. 7. In this case, the normal of the reshaped surface progressively diverges from the unmodified normal in the opposite direction from the divergence obtained by the internal modification. Refraction only occurs at the external lens/air interface, bending the rays toward the obstruction.

The preferred method of creating the modified internal optical surface (shown in FIG. 8) is to locate a new construction center (for the modified surface) that is offset from the center of the unmodified lens surfaces, and located at the intersection of two lines, one of which is defined by the point 36 of the unmodified lens surface center and the point 56 where the modified surface begins to diverge from the unmodified surface; and the other at 54 which is defined as the normal of the modified surface where the modified surface joins the obstruction. Creating the modified external surface is accomplished by locating the construction center at the intersection of two lines, one of which is normal to the external lens surface at the point where it is desired that the normals to the modified and unmodified surfaces are to begin to diverge; the other of which is the normal to the modified surface where the modified surface joins the obstruction. In both internal and external modification embodiments, the normals adjacent to the obstruction are calculated by application of the law of refraction with respect to the desired degree of refraction to negate the obscuration of rays by the obstruction.

Figure 8:
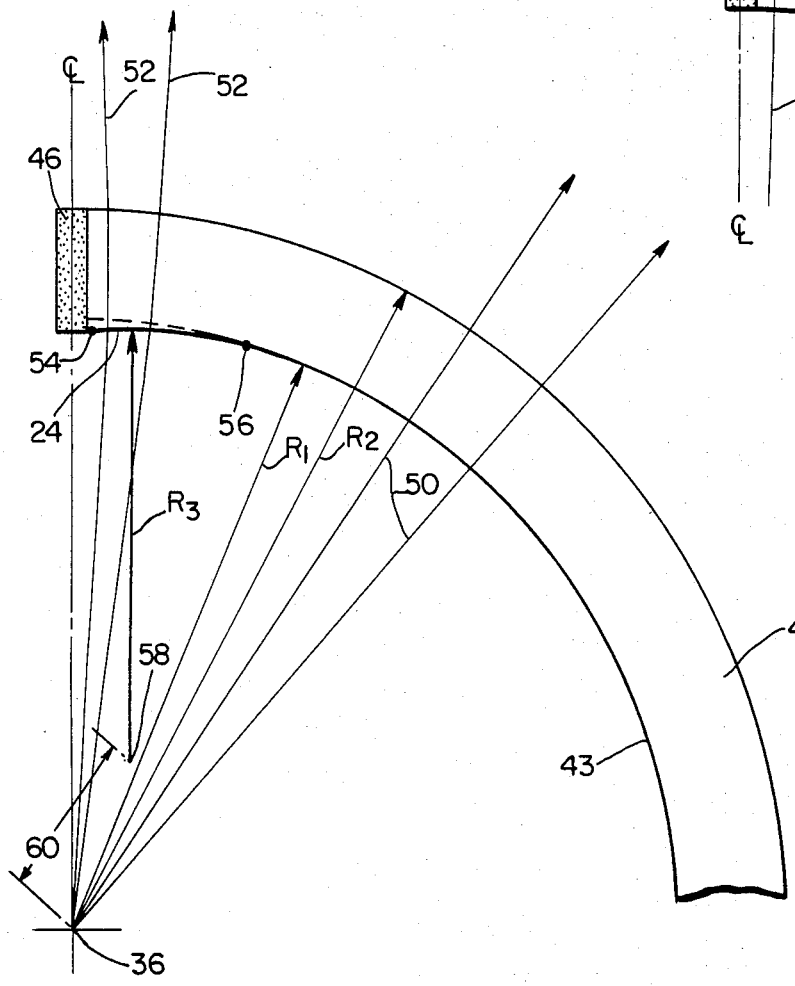
FIG. 8 is a detailed schematic plan view of the present invention showing light rays eminating from a single vertical filament and the refraction of the light rays by the modified surface adjacent the vertical divider or junction.

In FIG. 8 the internal surface 43 has a radius $R_1$, the external surface 44 has a radius $R_2$ and the modified surface 24 has a radius $R_3$. The origin 58 of the radius $R_3$ is offset a distance 60 from point 36 of the light source.

In a best mode of carrying out the invention $R_1=0.681$, $R_2=0.776$, $R_3=0.577$, and distance $60=0.103$.

FIG. 9 shows the light source 36, right lens segment 18 and left lens segment 20 having modified surfaces 24 and 26 joined at 22.

The junction 22 can be constructed as follows:

(a) A lens divider junction which employs an opaque vertical shield that extends radially outward from the assembly; and (b) A lens segment junction which is caused when two lens segments are physically joined together. A region is created on both sides of the junction where the bonding agent or process (chemical, ultrasonic, etc.) results in the inability of this area to transmit light through the region. The mating edges produced by ordinary tooling (such as injection molding) generally are imprecise enough to produce an obscuring junction at least as wide as the emitting surface of the filament in the light source. To a distant observer of the lighted assembly, undesirable eclipse of the filament by the junction is observed.

I claim:

1. A continuous lens assembly with uninterrupted arc of visibility comprising at least a first lens segment and a second lens segment and at least one junction at the edges thereof and consisting of a progressively thicker lens portion of each segment as said segment nears said junction for progressively imparting a greater degree of refraction in the area of said lens segments adjacent said junction for bending light rays in the direction of said junction.

2. The lens assembly of claim 1, wherein said segments have an outer surface and an inner surface.

3. The lens assembly of claim 2, wherein said thicker lens portion is located on said inner surface.

4. The lens assembly of claim 2, wherein said thicker lens portion is located on said outer surface.

5. The lens assembly of claim 3, wherein said inner surface has a given radius of curvature and said thicker lens portion has a radius of curvature different from said given radius of curvature.

6. The lens assembly of claim 4, wherein said outer surface has a given radius of curvature and said thicker lens portion has a radius of curvature different from said given radius of curvature.

7. The lens assembly of claim 5, wherein said given radius of curvature has a given origin and said thicker lens portion radius of curvature has an origin offset from said given origin.

8. The lens assembly of claim 6, wherein said given radius of curvature has a given origin, and said thicker lens portion radius of curvature has an origin offset from said given origin.

9. A marine navigation light comprising a continuous lens assembly with uninterrupted arc of visibility and a light source with a vertical filament, said lens assembly comprising at least a first lens segment and a second lens segment and at least one junction at the edges thereof and consisting of a progressively thicker lens portion of each segment as said segment nears said junction for progressively imparting a greater degree of refraction in the area of said lens segments adjacent said junction for bending light rays in the direction of said junction.

10. The marine navigation light of claim 9, wherein said segments have an outer surface and an inner surface.

11. The marine navigation light of claim 10, wherein said thicker lens portion is located on said inner surface.

12. The marine navigation light of claim 10, wherein said thicker lens portion is located on said outer surface.

13. The marine navigation light of claim 11, wherein said inner surface has a given radius of curvature and said thicker lens portion has a radius of curvature different from said given radius of curvature.

14. The marine navigation light of claim 12, wherein said outer surface has a given radius of curvature and said thicker lens portion has a radius of curvature different from said given radius of curvature.

15. The marine navigation light of claim 13, wherein said given radius of curvature has an origin located at said light source and said thicker lens portion radius of curvature has an origin offset from said light source.

16. The marine navigation light of claim 12, wherein said given radius of curvature has an origin located at said light source and said thicker lens portion radius of curvature has an origin offset from said light source.

17. A marine navigation light having a continuous lens assembly with uninterrupted arc of visibility comprising a first lens segment with a first inner surface and a first outer surface, a first given inner surface radius of curvature, and a first given outer surface radius of curvature, a second lens segment with a second inner surface and a second outer surface, a second given inner surface radius of curvature and a second given outer surface radius of curvature, a junction between said first and second lens segments, a light source having a vertical filament located at the origins of said radii of curvature, and consisting of a progressively thicker lens portion of each segment as said segment nears said junction for progressively imparting a greater degree of refraction in the area of said lens segments adjacent said junction for bending light rays in the direction of said junction.

18. The marine navigation light of claim 17, wherein said thicker lens portions are located on said first and second inner surfaces.

* * * * *